US008894172B2

(12) United States Patent
Mitsuzawa

(10) Patent No.: US 8,894,172 B2
(45) Date of Patent: Nov. 25, 2014

(54) IMAGE FORMING APPARATUS AND PROGRAM USING RADIATION CURABLE INK

(75) Inventor: Toyohiko Mitsuzawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 113 days.

(21) Appl. No.: 13/227,377

(22) Filed: Sep. 7, 2011

(65) Prior Publication Data

US 2012/0056926 A1 Mar. 8, 2012

(30) Foreign Application Priority Data

Sep. 8, 2010 (JP) ..... 2010-200576

(51) Int. Cl.
*B41J 29/38* (2006.01)
*B41J 2/21* (2006.01)
*B41J 11/00* (2006.01)

(52) U.S. Cl.
CPC ..... *B41J 2/2114* (2013.01); *B41J 11/002* (2013.01)
USPC ..... 347/14

(58) Field of Classification Search
CPC ..... B41J 11/002; B41J 2/2114
USPC ..... 347/102, 6, 14, 15
See application file for complete search history.

(56) References Cited

U.S. PATENT DOCUMENTS

| | | | | |
|---|---|---|---|---|
| 7,510,277 | B2 | 3/2009 | Konno et al. | |
| 7,976,145 | B2 | 7/2011 | Hara | |
| 2005/0190248 | A1 | 9/2005 | Konno et al. | |
| 2006/0203024 | A1 * | 9/2006 | Kusunoki | 347/15 |
| 2007/0013759 | A1 * | 1/2007 | Kadomatsu et al. | 347/102 |
| 2009/0322804 | A1 * | 12/2009 | Usuda et al. | 347/6 |
| 2010/0194838 | A1 | 8/2010 | Mitsuzawa | |

FOREIGN PATENT DOCUMENTS

| | | | |
|---|---|---|---|
| EP | 1 905 597 | A2 | 4/2008 |
| JP | 2005-280346 | A | 2/2005 |
| JP | 2005-280346 | A | 10/2005 |
| JP | 2006-015691 | A | 1/2006 |
| JP | 2007-268789 | A | 10/2007 |
| JP | 2009-255527 | A | 11/2009 |
| JP | 2010006027 | * | 1/2010 |

OTHER PUBLICATIONS

Extended European Search Report dated Apr. 16, 2012 as received in application No. 11 180 212.0.

* cited by examiner

*Primary Examiner* — Laura Martin
*Assistant Examiner* — Carlos A Martinez
(74) *Attorney, Agent, or Firm* — Maschoff Brennan

(57) ABSTRACT

An image forming apparatus which includes a head for discharging colored radiation curable ink and colorless radiation curable ink that are cured upon irradiation with electromagnetic waves onto a medium, and a controller for causing dots of the colored radiation curable ink and dots of the colorless radiation curable ink to be densely arranged.

11 Claims, 6 Drawing Sheets

IMAGE FORMING APPARATUS AND PROGRAM USING RADIATION CURABLE INK

CROSS REFERENCES TO RELATED APPLICATIONS

The entire disclosure of Japanese Patent Application No. 2010-200576, filed Sep. 8, 2010 is expressly incorporated herein by reference.

BACKGROUND

1. Technical Field

The present invention relates to image forming apparatuses and programs.

2. Related Art

One example of an image forming apparatus currently known in the art is a printer that uses radiation curable ink that is cured upon irradiation with electromagnetic waves such as ultraviolet rays. In such a printer, an irradiation section that applies electromagnetic waves is provided downstream in a transport direction from a head that discharges radiation curable ink (e.g., see JP-A-2005-280346).

In cases where the amount of discharge of ink per unit area is small, the radiation curable ink is affected by oxygen, which makes it difficult for the radiation curable ink to be cured. For example, in cases where the amount of discharge of ink per unit area is small, dots are formed in isolation without either being adjacent to one another or being placed on top of one another. The dots formed in isolation are strongly affected by oxygen, and therefore curing of the dots will not occur.

BRIEF SUMMARY OF THE INVENTION

An advantage of some aspects of the invention is that radiation curable ink is satisfactorily cured.

A first aspect of the invention is an image forming apparatus which includes a head that discharges colored radiation curable ink and colorless radiation curable ink onto a medium, the colored radiation curable ink and the colorless radiation curable ink being cured upon irradiation with electromagnetic waves, an irradiation section that irradiates the radiation curable ink on the recording medium with electromagnetic waves, and a controller that causes the colorless radiation curable ink to be discharged from the head to a unit area with an amount of discharge of the colored radiation curable ink equal to or less than a threshold, so that dots of the colored radiation curable ink and dots of the colorless radiation curable ink are densely arranged.

Other features of the invention will be clarified by the description given herein and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
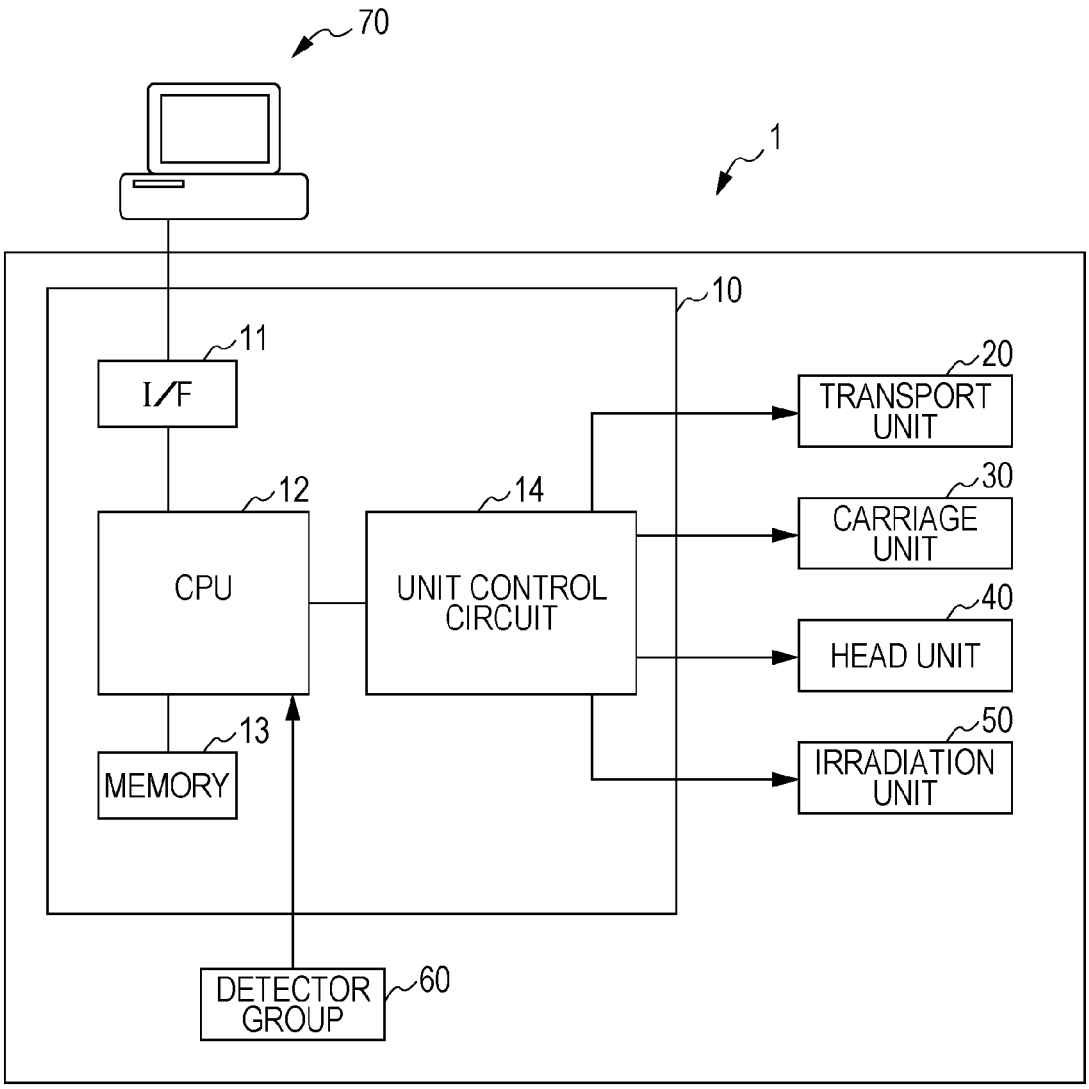
FIG. 1 is a block diagram illustrating a configuration of a printing system.

At least the following will become apparent from the description given herein and the accompanying drawings.

An image forming apparatus includes a head that discharges colored radiation curable ink and colorless radiation curable ink onto a medium, the colored radiation curable ink and the colorless radiation curable ink being cured upon irradiation with electromagnetic waves; an irradiation section that irradiates the radiation curable ink on the recording medium with electromagnetic waves; and a controller that causes the colorless radiation curable ink to be discharged from the head to a unit area where an amount of discharge of the colored radiation curable ink is equal to or less than a threshold, so that dots of the colored radiation curable ink and dots of the colorless radiation curable ink are densely arranged.

Such an image forming apparatus allows radiation curable ink to be satisfactorily cured.

In the image forming apparatus, a dot of the colored radiation curable ink is first formed in the unit area where the amount of discharge of the colored radiation curable ink is equal to or less than the threshold and a dot of the colorless radiation curable ink is formed on top of that.

Such an image forming apparatus allows dots of the colored radiation curable ink and dots of the colorless radiation curable ink to be densely arranged, which allows the radiation curable ink to be satisfactorily cured.

In the image forming apparatus, a dot of the colored radiation curable ink is formed in the unit area where the amount of discharge of the colored radiation curable ink is equal to or less than the threshold and a dot of the colorless radiation curable ink is formed adjacent to that.

Such an image forming apparatus allows dots of the colored radiation curable ink and dots of the colorless radiation curable ink to be densely arranged, which allows the radiation curable ink to be satisfactorily cured.

In the image forming apparatus, a dot of the colorless radiation curable ink is formed between a plurality of dots of the colored radiation curable ink in the unit area where the amount of discharge of the colored radiation curable ink is equal to or less than the threshold, and the plurality of dots of the colored radiation curable ink are connected through the dot of the colorless radiation curable ink.

Such an image forming apparatus allows dots of the colored radiation curable ink and dots of the colorless radiation curable ink to be densely arranged, which allows the radiation curable ink to be satisfactorily cured.

In addition, a program generates data for the image forming apparatus to form an image on a medium using colored radiation curable ink and colorless radiation curable ink, the colored radiation curable ink and the colorless radiation curable ink being cured upon irradiation with electromagnetic waves, the program causing a computer to implement generating dot data indicating whether a dot is to be formed, for the colored radiation curable ink; acquiring an amount of discharge of the colored radiation curable ink per unit area, on the basis of the dot data; and generating dot data for the colorless radiation curable ink so that dots of the colored radiation curable ink and dots of the colorless radiation curable ink are densely formed in a unit area where an amount of discharge of the colored radiation curable ink is equal to or less than a threshold.

With such a program, data with which radiation curable ink is satisfactorily cured can be generated.

Printing System

Embodiments will be described below, using a printing system in which an ink jet printer (hereinafter referred to as a "printer") which is connected to a computer as an example of an image forming apparatus capable of performing aspects of the invention.

Figure 2:
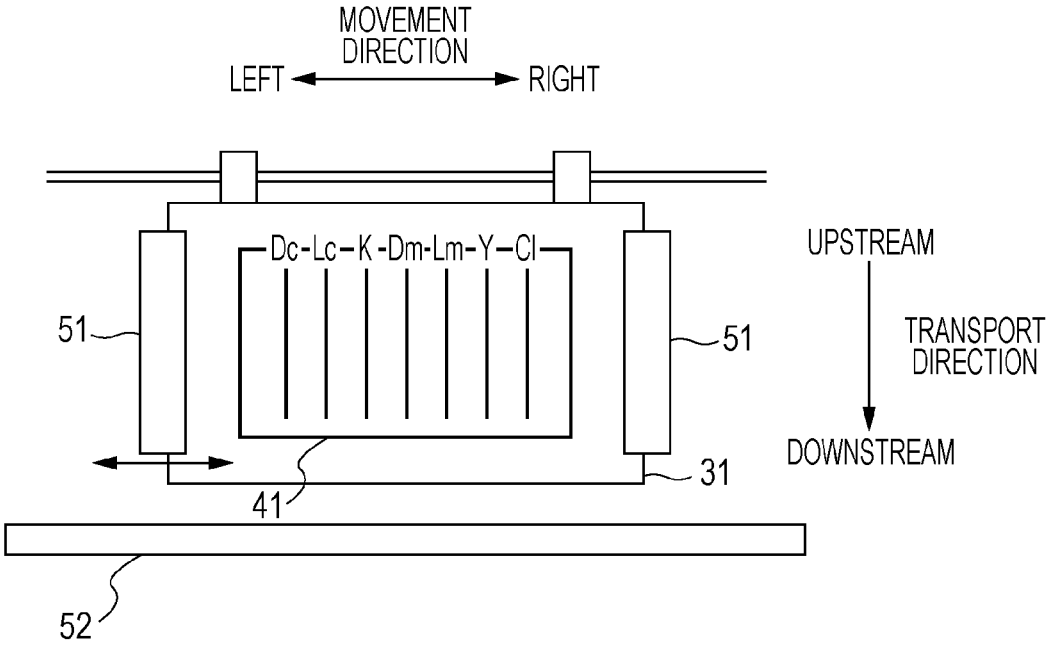
FIG. 2 is a schematic top view of the periphery of a head.

FIG. 1 is a block diagram illustrating a configuration of a printing system, and FIG. 2 is a schematic top view of the periphery of a head. A printer 1 of the embodiments is an apparatus that discharges ultraviolet curable ink (corresponding to "radiation curable ink"), which is cured by irradiation with ultraviolet rays, toward a medium such as a sheet of paper, cloth, or film so as to form an image on the medium. The ultraviolet curable ink (hereinafter abbreviated as "UV ink") is ink containing ultraviolet curable resin. Upon irradiation with ultraviolet rays, radical polymerization reactions occur in the ultraviolet curable resin, and, as a result, the ultraviolet curable ink is cured.

A computer 70 is connected to the printer 1 so as to be able to communicate therewith, and outputs to the printer 1 print data for allowing the printer 1 to print an image. A program (printer driver) for converting, into print data, image data that has been output using an application program is installed in the computer 70. The printer driver is stored in a recording medium (computer-readable recording medium) such as a compact disk read-only memory (CD-ROM), or can be downloaded onto a computer via the Internet.

The printer 1 that has received the print data from the computer 70 controls units by means of a controller 10 to print an image on a medium. A detector group 60 monitors the situation in the printer 1, and, based on a detection result of the detector group 60, the controller 10 controls units. An interface section 11 in the controller 10 is provided for the purpose of transmission and reception of data between the computer 70, which is an external device, and the printer 1. A central processing unit (CPU) 12 is a processing unit for controlling the entire printer 1. A memory 13 is provided in order to secure an area for storing programs of the CPU 12, a working area and the like. The CPU 12 controls units by using a unit control circuit 14.

A transport unit 20 is provided in order to transport a medium from an upstream side to a downstream side in a direction in which the medium is transported (hereinafter referred to as a "transport direction").

A carriage unit 30 is provided in order to move a head 41 to be described later in a direction in which the head 41 is moved (hereinafter referred to as a "movement direction") and that intersects the transport direction.

A head unit 40 includes the head 41 for discharging UV ink from nozzles onto a medium. The head 41 of the embodiments discharges colored UV ink (hereinafter referred to as "colored ink") in six colors and colorless transparent UV ink (hereinafter referred to as "clear ink"), and nozzle arrays for discharging UV ink in respective colors are formed on the head 41. In each nozzle array, a multiple of nozzles are aligned at regular intervals in the transport direction. FIG. 2 illustrates the nozzle arrays virtually seen from the top surface of the head 41. Aligned from the left in the movement direction in FIG. 2 are a dark cyan nozzle array Dc for discharging dark cyan ink, a light cyan nozzle array Lc for discharging light cyan ink, a black nozzle array K for discharging black ink, a dark magenta nozzle array Dm for discharging dark magenta ink, a light magenta nozzle array Lm for discharging light magenta ink, a yellow nozzle array Y for discharging yellow ink, a clear nozzle array Cl for discharging clear ink that is colorless and transparent. Regarding cyan and magenta, dark ink and light ink that are the same in hue and different in density are discharged from the head 41.

The head 41 discharges UV ink from the nozzles while moving together with a carriage 31 in the movement direction. It is to be noted that the method of discharging ink from the nozzles may be a piezoelectric method that applies voltage to a driving element to expand and contract a pressure chamber filled with ink, so that the ink is discharged, and may also be a thermal method that forms a bubble in a nozzle using a heating element and discharges ink by using the bubble.

An irradiation unit 50 (corresponding to the irradiation section) applies ultraviolet rays toward UV ink that has landed on a medium, so that the UV ink is cured. The printer 1 of the embodiments has two kinds of irradiation sections, preliminary irradiation sections 51 and a main irradiation section 52. UV ink is cured separately in two stages.

The preliminary irradiation sections 51 are provided on the carriage 31, and the length in the transport direction of the preliminary irradiation section 51 is approximately the same as that in the transport direction of the nozzle array. The preliminary irradiation section 51 irradiates UV ink with ultraviolet rays immediately after the UV ink has landed on a medium to such a degree that the UV ink is not completely cured. This can suppress the flow (spread of a dot) of UV ink that has landed on the medium. The two preliminary irradiation sections 51 are provided on the carriage 31 in such a fashion as to sandwich the head 41. As such, when the head 41 moves toward one side of the movement direction, and when the head 41 moves toward the other side of the movement direction, UV ink immediately after landing on a medium is irradiated with ultraviolet rays by the preliminary irradiation sections 51. Examples of a light source for irradiation with ultraviolet rays of the preliminary irradiation section 51 include a light emitting diode (LED).

The main irradiation section 52 is located more downstream in the transport direction than the carriage 31, and the length in the movement direction of the main irradiation section 52 is approximately the same as the length in the movement direction (the width) of a medium. Accordingly, the main irradiation section 52 irradiates, with ultraviolet rays, UV ink on a medium that has been transported to a location under the main irradiation section 52 by transportation operation, such that the UV ink is completely cured. Examples of a light source for irradiation with ultraviolet rays of the main irradiation section 52 include lamps such as a metal halide lamp and a mercury lamp.

With the printer 1 as described above, an image forming process and a transportation process are repeated. In the image forming process, UV ink is irradiated with ultraviolet rays by means of the preliminary irradiation section 51 while being discharged on an intermittent basis from the head 41 moving along the movement direction. In the transportation process, the medium is transported so as to be positioned on the downstream side of the head 41 in the transport direction. Such a repetition of these processes allows a dot to be formed by the current image forming process at a position different from that of a dot formed by the previous image forming process, so that a two-dimensional image is printed on a medium. It is to be noted that an operation in which the head 41 moves one time in the movement direction while discharging UV ink (one image forming process) is referred to as a "pass".

Effects of Oxygen on UV Ink

Figure 3:
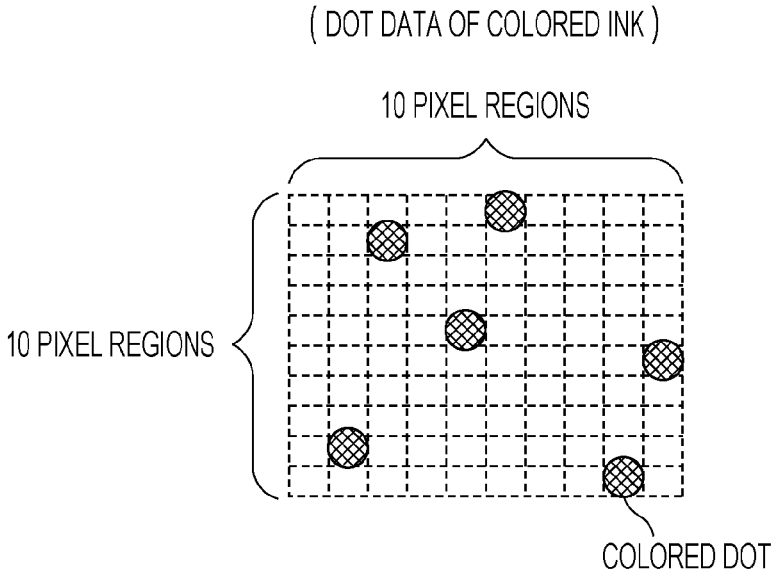
FIG. 3 illustrates dots formed on the basis of dot data for colored ink.

FIG. 3 illustrates dots formed on the basis of dot data (print data) for colored ink. One square in the figure is a "pixel region" that is the minimum area where one dot is formed on a medium, and the pixel region on the medium corresponds to a pixel of image data. Dot data is data indicating whether a dot is to be formed in each pixel region.

To achieve improvement in graininess of an image, typically, dot data is created so as to form dots such that the dots are scattered across an image. Accordingly, in cases where the density expressed in a unit area is light, and the amount of discharge of colored ink per unit area is small, a dot of colored ink (hereinafter referred to as a "colored dot") is formed in isolation, without either being adjacent to another colored dot or being placed on top of another colored dot, as illustrated in FIG. 3.

Upon irradiation with ultraviolet rays, UV ink used in the printer 1 of the embodiments is cured since radical polymerization reactions occur. When oxygen is attached to the UV ink, however, the oxygen functions as an inhibitor to decrease the chain polymerization rate. As a result, the UV ink is less likely to be curable (will not be cured). Particularly in cases where the amount of ink forming a dot is small (the thickness of an ink droplet is small), the surface area of the dot is large relative to its volume. This causes the dot to be more likely to be affected by oxygen, and, as a result, curing of the UV ink will not occur. If the UV ink is not cured, problems such as removal of the UV ink from a medium would arise.

In other words, in cases where the amount of discharge of colored ink per unit area is so small that a colored dot is formed in isolation, the colored dot is greatly affected by oxygen, and, as a result, curing will not occur.

To address such a problem, the embodiments are directed to reliably curing a colored dot even if the amount of discharge of colored ink per unit area is small.

For this purpose, regarding a unit area where the amount of discharge of colored ink is equal to or less than a threshold, the printer 1 of the embodiments discharges clear ink from the head 41 toward a medium, and densely arranges colored dots and dots of clear ink (hereinafter referred to as "clear dots") on the medium. As a result, the colored dots together with the clear dots are less likely to be affected by oxygen, and thus are reliably cured with ultraviolet rays.

In contrast, regarding a unit area where the amount of discharge of colored ink is more than the threshold, colored dots are not formed in isolation. The colored dots are unlikely to be affected by oxygen, and thus are reliably cured with ultraviolet rays. The printer 1 of the embodiments described herein do not discharge clear ink from the head 41 to form a clear dot in a unit area where the amount of discharge of colored ink is more than the threshold. This way allows the amount of consumption of clear ink to be reduced while colored dots are cured, and also allows printing control to be simplified.

It is to be noted that the threshold (i.e., the threshold for the amount of discharge of colored ink per unit area) as to whether a clear dot is to be formed may be set as an ink amount corresponding to a density that a colored dot is formed in isolation in a unit area.

UV ink discharged from the head 41 in a unit area where the amount of discharge of colored ink is equal to or less than the threshold is not limited to colorless transparent UV ink, and may be colorless UV ink.

The amount of discharge of colored ink per unit area can be replaced with a Duty value. The term "Duty value (%)" is the percentage of "the number of pixel regions where colored dots are formed and that are included in a unit area" in "the number of pixel regions included in the unit area". As the Duty value for colored ink decreases, the amount of discharge of colored ink per unit area decreases. As the Duty value for colored ink increases, the amount of discharge of colored ink per unit area increases. Thus, the printer 1 may discharge clear ink from the head 41 and densely arrange colored dots and clear dots in a unit area where the Duty value for colored ink is equal to or less than a threshold.

First Embodiment

Figure 4:
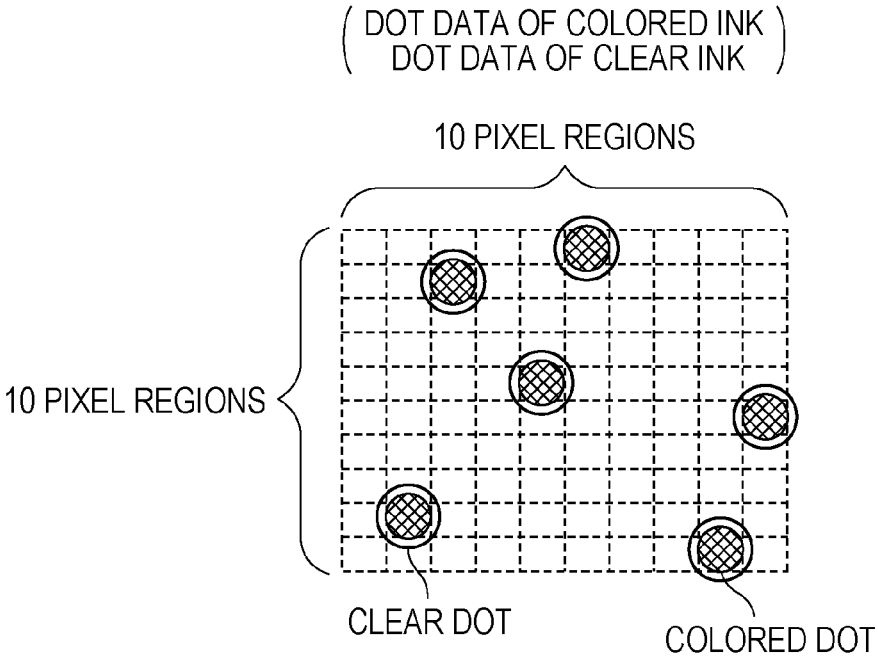
FIG. 4 illustrates a state of forming colored dots and clear dots in a first embodiment of the invention.

FIG. 4 illustrates a state of forming colored dots and clear dots in a first embodiment. In the figure, a colored dot is represented by a meshed dot, and a clear dot is represented by a bold solid line circle. In the first embodiment, a colored dot and a clear dot are formed on top of one another so that colored dots and clear dots are densely arranged in a unit area where the amount of discharge of colored ink is equal to or less than a threshold. In this way, the colored dots and the clear dots are less likely to be affected by oxygen, and insufficient curing can thus be prevented.

In the first embodiment, the printer driver creates print data so that a colored dot and a clear dot are formed on top of one another in the unit area where the amount of discharge of colored ink is equal to or less than a threshold. A method of creating print data by using the printer driver will be described below.

Figure 5:
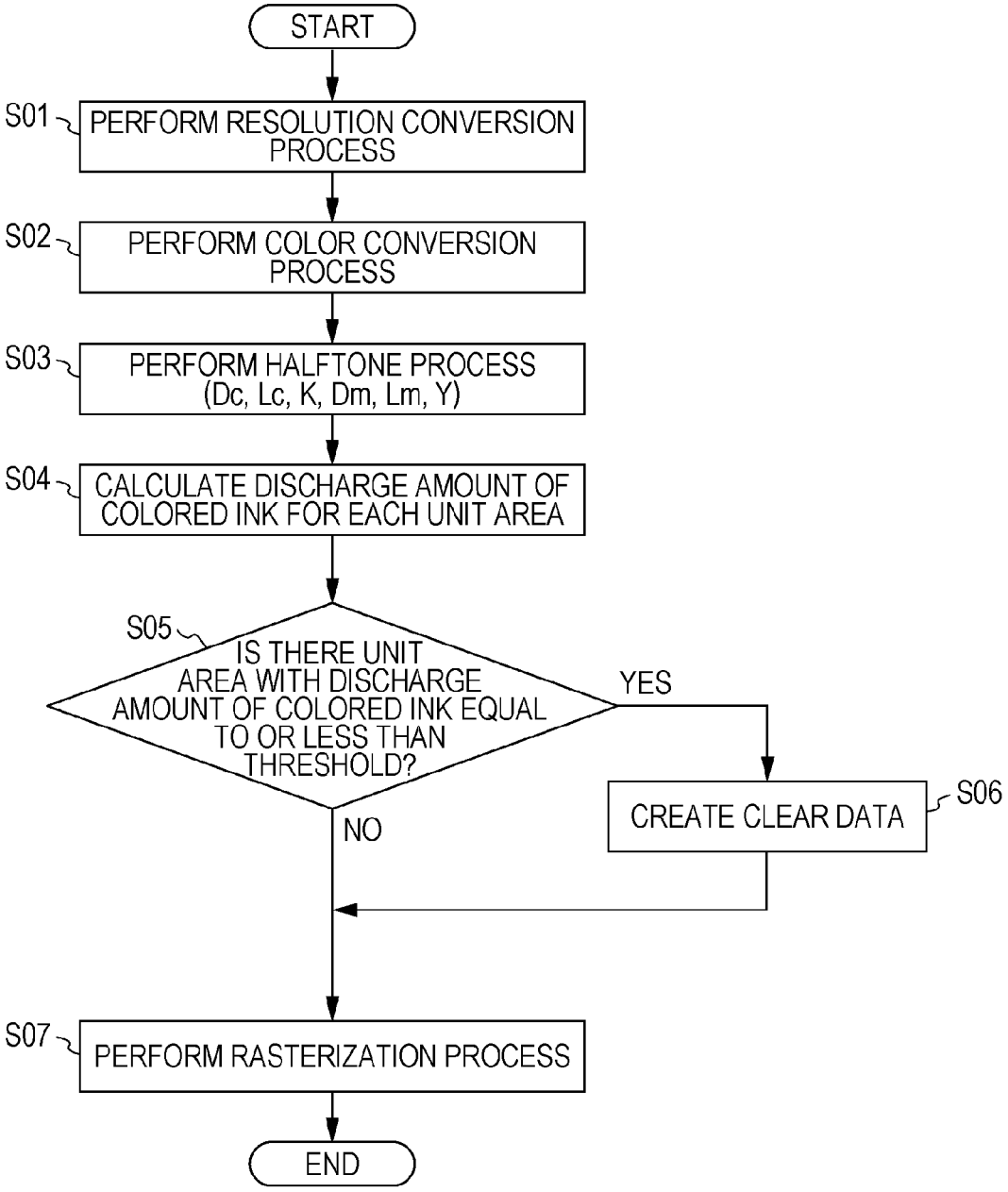
FIG. 5 illustrates a flow of creating print data.

FIG. 5 illustrates a flow of creating print data. Upon receiving image data to be printed by the printer 1 from various application programs, the printer driver creates print data utilizing hardware resources of the computer 70.

The printer driver first converts image data output from an application program to a set print resolution (S01). Next, the printer driver converts the image data, which is RGB data, into CMYK data corresponding to colors of ink that the printer 1 has (S02). This color conversion process is performed such that the printer driver refers to a table (not illustrated) in which gradation values of RGB data are associated with gradation values of CMYK data. At this point, image data is composed of cyan data C, magenta data M, yellow data Y, and black data K. Data of each color is made up of a plurality of pixels. The density of each pixel is expressed in multi-gradation levels. In this embodiment, the density of each pixel is expressed in 256 gradations (numbers from 0 to 255). The higher the gradation value, the darker the density is.

For the printer 1 of this embodiment, however, dark cyan ink Dc and light cyan ink Lc can be used as cyan ink, and dark magenta ink Dm and light magenta ink Lm can be used as magenta ink. Accordingly, the printer driver further converts the cyan data C into the dark cyan data Dc and the light cyan data Lc, and converts the magenta data M into the dark magenta ink Dm and the light magenta ink Lm.

Figure 6A:
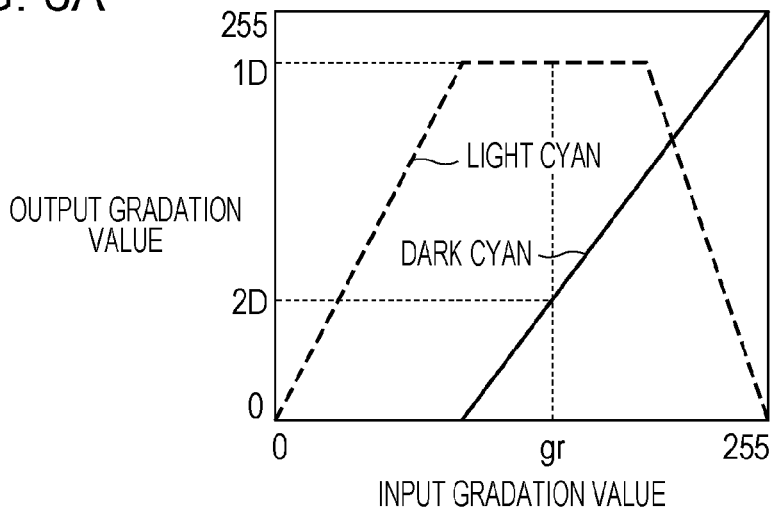
FIG. 6A is a graph illustrating a cyan gradation value conversion table.

FIG. 6A is a graph illustrating a cyan gradation value conversion table. The horizontal axis represents the input gradation value, and the vertical axis represents the output gradation value. The dotted line in the graph indicates the gradation value of light cyan, and the solid line indicates the gradation value of dark cyan. For example, the gradation value of some pixels included in the cyan data C is assumed to be gr. In this case, based on the conversion table of FIG. 6A, the printer driver sets the gradation value of dark cyan of the pixel to 2D, and sets the gradation value of light cyan to 1D. In this way, the printer driver converts the cyan data C into the dark cyan data Dc and the light cyan data Lc. Similarly, the printer driver converts the magenta data M into the dark magenta data Dm and the light magenta data Lm on the basis of a magenta gradation value conversion table (not illustrated).

Figure 6B:
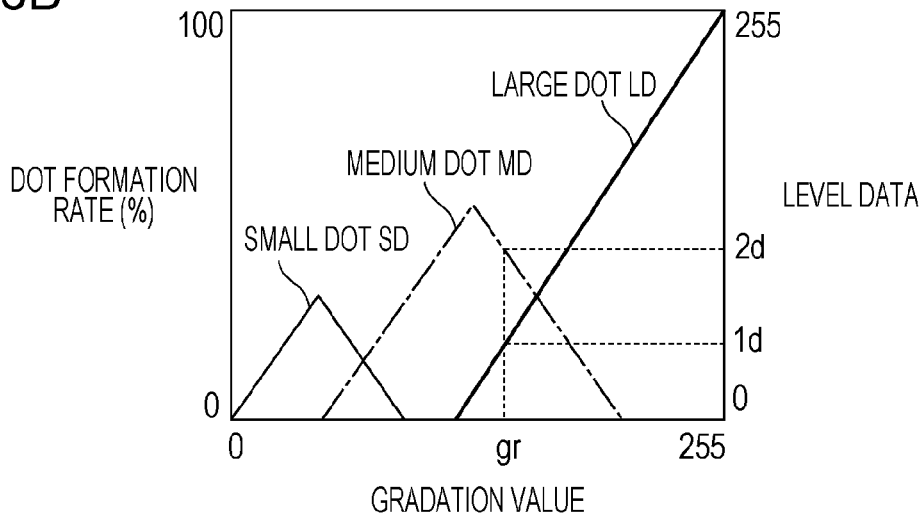
FIG. 6B illustrates a halftone process.
Figure 6C:
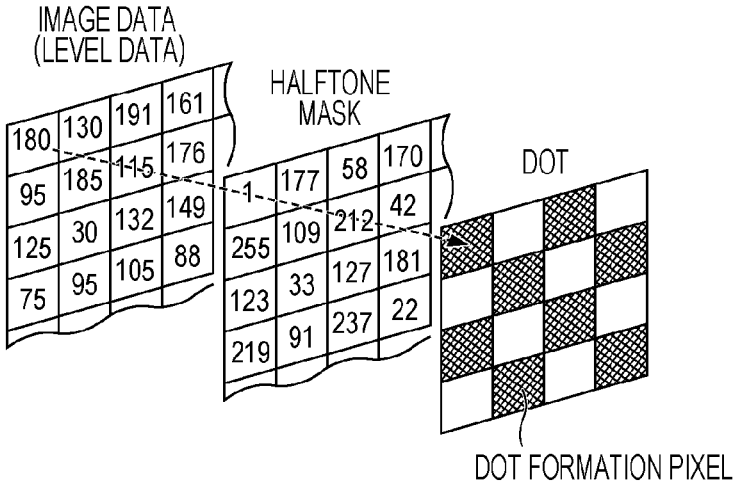
FIG. 6C illustrates the halftone process.

FIG. 6B and FIG. 6C illustrate a halftone process. The printer driver next performs the halftone process (S03). The halftone process is a process for converting multi-gradation data into data having the number of gradations that can be expressed by the printer 1. Here, for colored ink in six colors, dot data indicating whether a dot is to be formed is created.

It is to be noted that the printer 1 of this embodiment is assumed to be able to form dots of three sizes: large dots, medium-size dots, and small dots. With the halftone process, 256 gradation data is converted into 4 gradation data. In this embodiment, a description is given, taking a halftone process using dithering as an example. However, the halftone process is not limited to this. For example, an error dispersion method, an FM mask method, and a blue noise mask method may be used.

FIG. 6B is a graph illustrating a dot formation rate table. The horizontal axis of the graph represents the gradation value (0 to 255), the vertical axis on the left side in the graph represents the dot formation rate (0 to 100%), and the vertical axis on the right side in the graph represents the level data. The solid line in the graph indicates a small-dot formation rate SD, the dot-and-dash line indicates a medium-size-dot formation rate MD, and the bold solid line indicates a large-dot formation rate LD.

The term "level data" refers to data expressing the dot formation rate (0 to 100%) using values "0 to 255". The term "dot formation rate" refers to a rate at which dots are formed in pixels in a unit area in the case where the gradation values of pixels included in the unit area are constant. For example, in the case where all of the pixels (10 pixels×10 pixels) included in a unit area have a predetermined gradation value, it is assumed that n dots are formed in the unit area. In this case, the dot formation rate at the predetermined gradation value is: $\{n/(10\times10)\}\times100(\%)$.

A specific halftone process will be described below, taking the black data K as an example. First, the printer driver takes a pixel whose gradation value is to be converted (target pixel) out of pixels included in the black data K. Then, the printer driver refers to the dot formation rate table of FIG. 6B, and sets large-dot level data in accordance with the gradation value of the target pixel. For example, given that the gradation value of the target pixel is gr, the large-dot level data is set to 1*d*.

FIG. 6C illustrates a state of determining whether a dot is to be formed. The printer driver determines whether to form a dot or not based on which is larger or smaller between the gradation value (level data) of the target pixel and the threshold of a halftone mask corresponding to the target pixel. For example, assume that the target pixel is a pixel in the upper left corner of image data of FIG. 6C, and the large-dot level data 1*d* is "180". The printer driver refers to the halftone mask and determines that the threshold corresponding to the upper left target pixel is "1". The printer driver compares the large-dot level data "180" of the target pixel with the threshold "1", and determines that the large-dot level data is larger than the threshold (180>1). In this case, the target pixel is converted into a "pixel where a large dot is to be formed", and thus processing for that target pixel is completed.

On the other hand, in the case where the large-dot level data of the target pixel is equal to or less than the threshold, the printer driver sets medium-size-dot level data (2*d*) of the target pixel. Then, the printer driver compares the medium-size-dot level data 2*d* with the threshold of the halftone mask, and converts the target pixel into a "pixel where a medium-size dot is to be formed" if the medium-size-dot level data 2*d* is larger than the threshold. If the medium-size-dot level data 2*d* is equal to or less than the threshold, the printer driver sets small-dot level data of the target pixel, performs a comparison with the threshold, and determines whether a small dot is to be formed.

After the target pixel has been converted into data of 4 gradations (data indicating which of three kinds of dots is to be formed), the printer driver performs similar processing for other pixels included in the black data K. Further, after processing for all pixels included in the black data K has been completed, the printer driver performs similar processing for image data of other colors.

As a result, pixels included in 6-color (colored) image data (the dark cyan data Dc, the light cyan data Lc, the dark magenta ink Dm, the light magenta ink Lm, the yellow data Y, and the black data K) are converted into data ranging from 256 gradation data to 4 gradation data (dot data).

Next, the printer driver acquires (calculates) the amount of discharge of colored ink for each unit area on the basis of the result (dot data) of the halftone process for colored ink in six colors (S04). That is, the printer driver calculates the total amount of colored ink in six colors (Dc, Lc, Dm, Lm, Y, and K) discharged in each unit area. For this purpose, the printer driver refers to data of pixels included in unit areas positioned at the same locations in image data of colors. It is to be noted that assuming that a unit area on a medium is "10 pixel regions×10 pixel regions", a unit area on image data corresponding to the unit area on the medium is "10 pixels×10 pixels".

The printer driver next determines whether there is a unit area where the amount of discharge of colored ink is equal to or less than the threshold (S05). If there is no unit area where the amount of discharge of colored ink is equal to or less than the threshold, a colored dot is not formed in isolation, and is adjacent to another dot or is placed on top of another dot. Therefore, even if a clear dot is not formed adjacent to a colored dot, the colored dot is unlikely to be affected by oxygen, and thus is reliably cured.

Thus, if there is no unit area where the amount of discharge of colored ink is equal to or less than the threshold (S05→N), the printer driver goes to the next rasterization process (S07) without creating clear data indicating whether a clear dot is to be formed. In this case, print data created by the printer driver is composed of dot data (Dc, Lc, Dm, Lm, Y and K) for colored ink in six colors. Creating print data in this manner enables colored dots to be reliably cured and the time for creating print data to be made as short as possible, and also enables the amount of consumption of clear ink to be reduced.

On the other hand, if there is a unit area where the amount of discharge of colored ink is equal to or less than the threshold (S→Y), the printer driver creates clear data (S06). In the unit area where the amount of discharge of colored ink is equal to or less than the threshold, a colored dot is formed in isolation, and, because of the effect of oxygen, the colored dot will not be cured. To address this issue, the printer driver creates clear data so that a clear dot is formed on top of a colored dot as illustrated in FIG. 4 in the unit area where the amount of discharge of colored ink is equal to or less than the threshold. In this case, the print data created by the printer driver is made up of dot data for colored ink in six colors and dot data for clear ink. Creating print data in this manner allows a colored dot and a clear dot to be formed on top of one another in the unit area where the amount of discharge of colored ink is equal to or less than the threshold, and insufficient curing due to the effect of oxygen can thus be prevented.

Specifically, the printer driver, when creating clear data, converts a pixel positioned at the same location as a pixel where a colored dot is formed, among pixels corresponding to unit areas where the amount of discharge of colored ink is equal to or less than the threshold, into a "pixel where a (clear) dot is to be formed". It is to be noted that the size of a clear dot may be the same as that of a colored dot on top of which the clear dot is formed, may be fixed to any of three sizes in which the colored dot can be formed, and may be different from that of the colored dot.

Finally, the printer driver rasterizes the result (dot data) of the halftone process (S07). Rasterization is a process that rearranges two-dimensional dot data in the order of data to be transferred to the printer 1. Dot data produced through these processes, together with command data (such as a transport amount) according to a print mode, is transmitted as print data to the printer 1. On the basis of the received print data, the printer 1 (the controller 10) controls units to print an image on a medium.

In the halftone process of this embodiment, the dot formation rate table illustrated in FIG. 6B is used. In the dot formation rate table illustrated in FIG. 6B, with a low gradation value (a gradation value representing a light density), only the small-dot formation rate SD is larger than zero, and the medium-size-dot formation rate MD and the large-dot formation rate LD are zero. Accordingly, in a unit area expressed at a light density, that is, a unit area where the amount of discharge of colored ink is equal to or less than the threshold, only small dots are likely to be formed.

However, dot formation is not limited to this, and dots in a plurality of sizes are sometimes formed in a unit area where the amount of discharge of colored ink is equal to or less than a threshold. With an increase in dot size, the amount of ink included in a dot increases, and the dot becomes less likely to be affected by oxygen. Therefore, the larger the size of a colored dot, the less the colored dot is affected by oxygen even if the amount of clear ink for forming a clear dot on top of the colored dot is small, and thus the colored dot is reliably cured.

The sizes of clear dots that are formed on top of colored dots may differ (the amounts of clear ink discharged from the head 41 may differ) in accordance with the sizes of the colored dots. For example, in a unit area where the amount of discharge of colored ink is equal to or less than a threshold, a large dot of clear ink may be placed on top of a small dot of colored ink, a medium-size dot of clear ink may be placed on top of a medium-size dot of colored ink, and a small dot of clear ink may be placed on top of a large dot of colored ink.

The above method can prevent clear ink from being needlessly consumed. Needless consumption of clear ink would occur, for example, in the case where, in spite of the fact that insufficient curing can be prevented by placing a small dot of clear ink on top of a large dot of colored ink, a large dot of clear ink is placed on top of a large dot of colored ink. In contrast, the above method can also prevent insufficient curing. Insufficient curing occurs in the case where, in spite of the fact that a large dot of clear ink needs to be placed on top of a small dot of colored ink, a small dot of clear ink is placed on top of a small dot of colored ink. That is, discharging an appropriate amount of clear ink in accordance with the amount of ink included in a colored dot makes it possible to reduce needless consumption of clear ink while reliably curing the colored dot.

Clear dots are formed on top of all colored dots in FIG. 4; however, formation of dots is not limited to this. For example, even in a unit area where the amount of discharge of colored ink is equal to or less than the threshold, part of colored dots is sometimes adjacent to or on top of another colored dot, so that some colored dots are not formed in isolation. If a colored dot is not formed in isolation, the colored dot is unlikely to be affected by oxygen, which eliminates the possibility of insufficient curing. In such a case, clear dots may be formed on top of only colored dots formed in isolation. That is, clear dots are formed on top of colored dots that can be insufficiently cured, which makes it possible to reduce needless consumption of clear ink.

Second Embodiment

Figure 7:
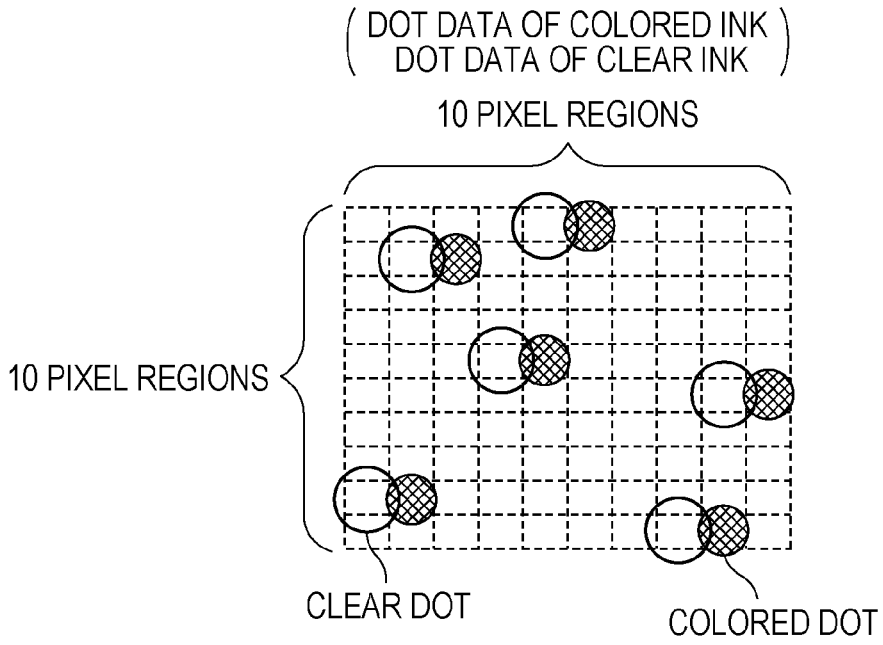
FIG. 7 illustrates a state of forming colored dots and clear dots in a second embodiment of the invention.

FIG. 7 illustrates a state of forming colored dots and clear dots in a second embodiment. In the second embodiment, clear dots are formed adjacent to colored dots so that the colored dots and the clear dots are densely arranged in a unit area where the amount of discharge of colored ink is equal to or less than a threshold. In this manner, the colored dots and the clear dots become less likely to be affected by oxygen, and insufficient curing can thus be prevented.

In the second embodiment, the printer driver creates print data so that a colored dot and a clear dot are formed adjacent to one another in a unit area where the amount of discharge of colored ink is equal to or less than a threshold. Like the foregoing first embodiment, the printer driver performs a halftone process of image data for colored ink in six colors, and, on the basis of a result of the halftone process, the printer driver next determines whether there is a unit area where the amount of discharge of colored ink is equal to or less than the threshold (S01 to S05 of FIG. 5).

If there is a unit area where the amount of discharge of colored ink is equal to or less than the threshold, the printer driver creates clear data. The printer driver creates clear data such that a clear dot is adjacent to a colored dot as illustrated in FIG. 7 in the unit area where the amount of discharge of colored ink is equal to or less than the threshold. Specifically, the printer driver, when creating clear data, converts a pixel adjacent to a pixel positioned at the same location as a pixel where a colored dot is formed, among pixels corresponding to the unit area where the amount of discharge of colored ink is equal to or less than the threshold, into a "pixel where a (clear) dot is to be formed". It is to be noted that pixels adjacent to a certain pixel refer to four pixels arranged on the left, right, top, and bottom of the certain pixel and four pixels arranged diagonally on top and bottom of the certain pixel, that is, eight pixels around the certain pixel.

The printer 1 prints an image on the basis of the print data created in this way, so that clear dots are formed adjacent to colored dots in a unit area where the amount of discharge of colored ink is equal to or less than a threshold, and insufficient curing due to the effect of oxygen can thus be prevented.

It is to be noted that while clear dots are formed to the left of all colored dots in FIG. 7, formation of dots is not limited to this. For example, clear dots may be formed to the right of colored dots, and may be formed on top of colored dots. The position at which a clear dot is adjacent to a colored dot may vary from one colored dot to another. In addition, one clear dot is adjacent to one colored dot in FIG. 7; however, a plurality of clear dots may be adjacent to one colored dot.

Moreover, if dots in a plurality of sizes are sometimes formed in a unit area where the amount of discharge of colored ink is equal to or less than a threshold, the sizes of the adjacent clear dots may differ, or the numbers of adjacent clear dots may differ, in accordance with the sizes of colored dots. This allows an appropriate amount of clear ink in accordance with the amount of ink included in a colored dot to be discharged, which makes it possible to reduce needless consumption of clear ink while the colored dot is reliably cured.

Moreover, in a unit area where the amount of discharge of colored ink is equal to or less than a threshold, a clear dot may be formed on top of a colored dot as in the first embodiment while a clear dot is formed adjacent to a colored dot.

Moreover, in a unit area where the amount of discharge of colored ink is equal to or less than a threshold, clear dots may be formed adjacent only to colored dots formed in isolation.

Third Embodiment

Figure 8:
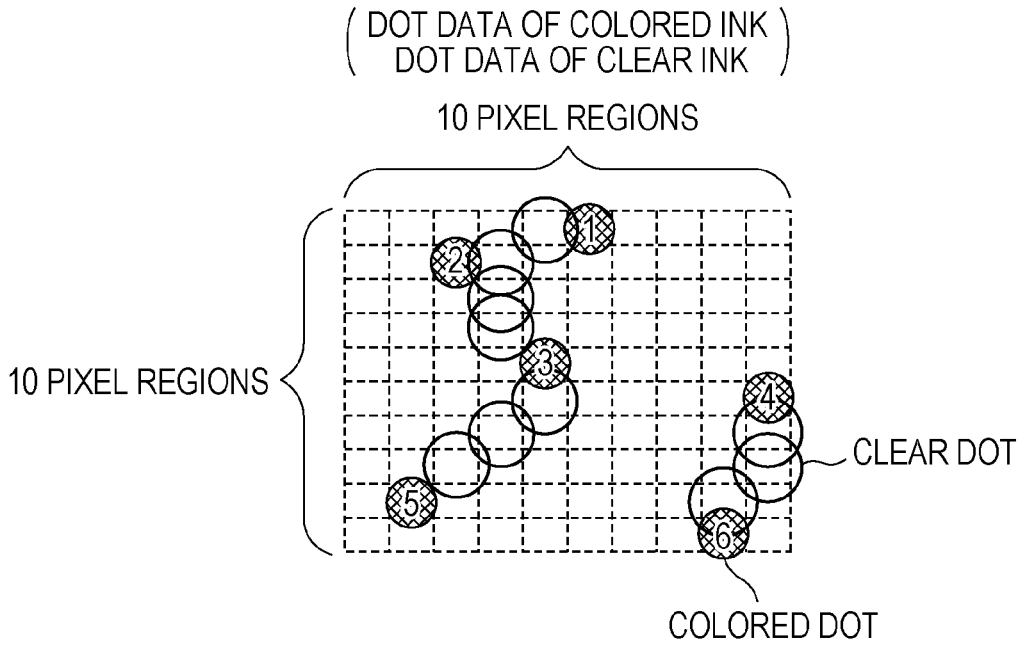
FIG. 8 illustrates a state of forming colored dots and clear dots in a third embodiment of the invention.

FIG. 8 illustrates a state of forming colored dots and clear dots in a third embodiment. It is to be noted that, in FIG. 8, six colored dots are formed in a unit area, and numerals are marked within the colored dots in order to identify each colored dot. In the third embodiment, clear dots are formed between a plurality of colored dots, and the plurality of colored dots are connected through the clear dots (at least two colored dots are connected) in a unit area where the amount of discharge of the colored radiation curable ink is equal to or less than a threshold. In other words, clear dots are formed adjacent to colored dots and further a clear dot is formed between the colored dots. In this way, the colored dots and the clear dots are less likely to be affected by oxygen, and insufficient curing can thus be prevented.

In the third embodiment, the printer driver creates print data so that clear dots are formed between colored dots in a unit area where the amount of discharge of colored ink is equal to or less than a threshold. Like the foregoing first embodiment, the printer driver performs a halftone process of image data for colored ink in six colors, and, on the basis of a result of the halftone process, the printer driver next determines whether there is a unit area where the amount of discharge of colored ink is equal to or less than a threshold (S01 to S05 of FIG. 5).

If there is a unit area where the amount of discharge of colored ink is equal to or less than the threshold, the printer driver creates clear data. The printer driver creates clear data so that clear dots are formed between colored dots, and a plurality of colored dots are connected through the clear dots, as illustrated in FIG. 8, in the unit area where the amount of discharge of colored ink is equal to or less than the threshold.

For example, the printer driver search for a pixel where a colored dot is to be formed, in the order from a left upper pixel in pixels (10 pixels×10 pixels) corresponding to a unit area where the amount of discharge of colored ink is equal to or less than a threshold. Then, upon recognizing a pixel where a colored dot of numeral 1 illustrated in FIG. 8 is to be formed, the printer driver searches for a pixel where a colored dot is to be formed (a pixel where a colored dot of numeral 2 is formed in FIG. 8) and that is the closest to the pixel where the colored dot of numeral 1 is to be formed. Then, the printer driver converts a pixel positioned between the pixel where the colored dot of numeral 1 is to be formed and the pixel where the colored dot of numeral 2 is to be formed, into a pixel where a clear dot is to be formed. This way enables the colored dot of numeral 1 and the colored dot of numeral 2 to be connected through the clear dot.

Thereafter, the printer driver searches for a new pixel where a colored dot is to be formed. If the printer driver recognizes the pixel where the colored dot of numeral 2 is to be formed, the printer driver does not perform a search for a pixel where a colored dot is to be formed and that is close to the pixel where the colored dot of numeral 2 is to be formed, since the colored dot of numeral 2 is connected through the clear dot to the colored dot of numeral 1.

On the other hand, if the printer driver recognizes a pixel where a colored dot of numeral 3 is to be formed, the colored dot of numeral 3 is not connected to any other colored dot, and therefore the printer driver searches for a pixel where a colored dot is to be formed (the pixel where the colored dot of numeral 2 is formed in FIG. 8) and that is the closest to the pixel where the colored dot of numeral 3 is to be formed. Then, the printer driver converts a pixel positioned between the pixels into a pixel where a clear dot is to be formed.

The printer 1 prints an image on the basis of the print data created in this way, so that a clear dot is formed between a plurality of colored dots, and the plurality of colored dots are connected through the clear dot in a unit area where the amount of discharge of colored ink is equal to or less than a threshold, and insufficient curing due to the effect of oxygen can thus be prevented.

It is to be noted that, in a unit area where the amount of discharge of colored ink is equal to or less than a threshold, a clear dot may be formed on top of a colored dot as in the first embodiment while a clear dot is formed between colored dots.

Other Embodiments

The foregoing embodiments mainly describe a printing system including an ink jet printer; however, a method of creating print data, and the like are also disclosed. Also, the foregoing embodiments are intended to facilitate understanding of the invention, and should not be interpreted as limiting the invention. It is to be understood that the foregoing embodiments may be changed and modified without departing from the spirit of the invention, and the invention includes equivalents of the embodiments.

Image Forming Apparatus

In the foregoing embodiments, the printer driver (corresponding to the program) creates print data utilizing hardware resources of the computer 70 so that dots of colored UV ink and dots of colorless UV ink are densely arranged, in the case where the amount of discharge of colored ink per unit area is equal to or less than a threshold, and, on the basis of the print data, the controller 10 of the printer 1 controls printing of an image onto a medium. Thus, the controller 10 of the printer 1 and the computer 70 in which the printer driver is installed correspond to the "controller", and the printing system in which the printer 1 and the computer 70 are connected corresponds to the "image forming apparatus".

However, the configuration is not limited to this. The roles of the printer driver and the computer 70 may be shouldered by the controller 10 of the printer 1. In this case, the controller 10 of the printer 1 corresponds to the "controller", and the printer 1 independently corresponds to the "image forming apparatus".

Printer

In the foregoing embodiments, the printer in which the operation of forming an image while moving the head 41 in the movement direction and the operation of transporting the medium are repeated as illustrated in FIG. 2 is taken as an example. However, the printer is not limited to this. For example, a printer may be used that discharges UV ink from a head group while transporting a medium under the head group, which is fixed, and cures UV ink on the medium by means of an ultraviolet ray irradiation section disposed on the downstream side of the head group in the medium transport direction. Also, in the foregoing embodiments, the printer provided with the preliminary irradiation sections 51 in addition to the main irradiation section 52 is taken as an example. A printer without the preliminary irradiation section 51 may be used.

Ink

In the foregoing embodiments, ultraviolet curable ink (UV ink) is taken as an example of the ink. However, the ink is not limited to this. For example, ink that is cured upon irradiation with electromagnetic waves such as electron beams, X-rays, or visible light from the head 41 may be discharged. In this case, the preliminary irradiation sections 51 and the main irradiation section 52 apply electromagnetic waves in accordance with ink.

What is claimed is:

1. An image forming apparatus comprising:

a head that discharges colored radiation curable ink and colorless radiation curable ink onto a recording medium, the colored radiation curable ink and the colorless radiation curable ink being cured upon irradiation with electromagnetic waves;

an section that irradiates the radiation curable ink on the recording medium with electromagnetic waves; and a controller that causes the colorless radiation curable ink to be discharged from the head to a unit area where an amount of discharge of the colored radiation curable ink is equal to or less than a predetermined threshold amount of discharged colored radiation curable ink, wherein the head is able to discharge a dot of the colored radiation curable ink and the colorless radiation curable ink, wherein a plurality of dots of the colored radiation curable ink formed in the unit area when the amount of discharge of the colored radiation curable ink is equal to or less than the predetermined threshold amount of discharged colored radiation curable ink are separated from each other, wherein a plurality of dots of the colorless radiation curable ink are separated from each other, and wherein the plurality of dots of colored radiation curable ink are in contact with the plurality of dots of the colorless radiation curable ink.

2. The image forming apparatus according to claim 1, wherein the head is able to discharge a first size dot and a second size dot which is a size of the dot is larger than the first size dot, wherein the second size dot of the colorless radiation curable ink is discharged on the first size dot of the colored radiation curable ink in the unit area where the amount of discharge of the colored radiation curable ink is equal to or less than the predetermined threshold amount of discharged colored radiation curable ink.

3. The image forming apparatus according to claim 1 or 2, wherein the head is able to discharge a first size dot and a second size dot which is a size of the dot is larger than the first size dot, wherein the first size dot of the colorless radiation curable ink is discharged on the second size dot of the colored radiation curable ink in the unit area where the amount of discharge of the colored radiation curable ink is equal to or less than the predetermined threshold amount discharged colored radiation curable ink.

4. A computer program that causes a computer to function as the controller according to claim 2.

5. A computer program that causes a computer to function as the controller according to claim 3.

6. A computer program that causes a computer to function as the controller according to claim 1.

7. A method of forming an image using an Image forming apparatus, the method comprising:

discharging colored radiation curable ink and colorless radiation curable ink from a head onto a recording medium, the colored radiation curable ink and the colorless radiation curable ink being configured so as to cure upon irradiation with electromagnetic waves;

irradiating the radiation curable ink on the recording medium with electromagnetic waves using an section; and determining whether an amount of discharge of the colored radiation curable ink is equal to or less than a predetermined threshold amount of discharged colored radiation curable ink in a unit area; and discharging the colorless radiation curable ink from the head to the unit area where an amount of discharge of the colored radiation curable ink is determined to be equal to or less than the predetermined threshold amount of discharged colored radiation curable ink, wherein the head is able to discharge a plurality of different sized dots of the colored radiation curable ink and the colorless radiation curable ink, wherein a plurality of dots of the colored radiation curable ink formed in the unit area when the amount of discharge of the colored radiation curable ink is equal to or less than the predetermined threshold amount of discharged colored radiation curable ink are separated from each other, wherein a plurality of dots of the colorless radiation curable ink are separated from each other, and wherein the plurality of dots of colored radiation curable ink are in contact with the plurality of dots of the colorless radiation curable ink.

8. The method according to claim 7, wherein discharging the colorless radiation curable ink from the head to the unit area comprises forming a dot of the colorless radiation curable ink on top of a dot of the colored radiation curable ink.

9. The method according to claim 7, wherein discharging the colorless radiation curable ink from the head to the unit area comprises forming a dot of the colorless radiation curable ink adjacent to a dot of the colored radiation curable ink.

10. The method according to claim 7, wherein discharging the colorless radiation curable ink from the head to the unit area comprises forming a dot of the colorless radiation curable ink between a plurality of dots of the colored radiation curable ink such that the plurality of dots of the colored radiation curable ink are connected through the dot of the colorless radiation curable ink.

11. An image forming apparatus comprising:

a head that discharges colored radiation curable ink and colorless radiation curable ink onto a recording medium, the colored radiation curable ink and the colorless radiation curable ink being cured upon irradiation with electromagnetic waves;

a section that irradiates the radiation curable ink on the recording medium with electromagnetic waves; and a controller that causes the colorless radiation curable ink to be discharged from the head to a unit area where an amount of discharge of the colored radiation curable ink is equal to or less than a predetermined threshold amount of discharged colored radiation curable ink, wherein the head is able to discharge a dot of the colored radiation curable ink and the colorless radiation curable ink, wherein the amount of discharge of a plurality of dots of the colored radiation curable ink formed in the unit area is equal to or less than the predetermined threshold amount, the controller creates colorless print data which causes the colorless radiation curable ink to discharge a plurality of dots of the colorless radiation curable ink so as to connect the plurality of dots of the colored radiation curable ink.

* * * * *